US005839277A

United States Patent [19]

Ideta et al.

[11] Patent Number: 5,839,277

[45] Date of Patent: Nov. 24, 1998

[54] EXHAUST DEVICE FOR AN INTERNAL COMBUSTION ENGINE

[75] Inventors: Hiroyuki Ideta; Hiroyuki Niwa; Makoto Ichihara, all of Hamamatsu, Japan

[73] Assignee: Suzuki Motor Corporation, Shizuoka-ken, Japan

[21] Appl. No.: 774,363

[22] Filed: Dec. 27, 1996

[30] Foreign Application Priority Data

Dec. 29, 1995 [JP] Japan ..... 7-354261

[51] Int. Cl.[6] ..... F01N 7/00

[52] U.S. Cl. ..... 60/322; 285/187; 285/224

[58] Field of Search ..... 60/299, 322; 285/187, 285/224, 226

[56] References Cited

U.S. PATENT DOCUMENTS

| | | | |
|---|---|---|---|
| 2,470,989 | 5/1949 | Keller et al. | 285/224 |
| 2,611,238 | 9/1952 | Fryer et al. | 60/322 |
| 3,837,685 | 9/1974 | Miller | 285/226 |
| 3,864,909 | 2/1975 | Kern | 60/322 |
| 4,060,263 | 11/1977 | Kotcharian | 285/226 |
| 4,168,090 | 9/1979 | Kaufmann, Jr. | 285/302 |
| 4,250,708 | 2/1981 | Tanahashi et al. | 60/322 |
| 4,645,247 | 2/1987 | Ward | 285/399 |
| 5,167,430 | 12/1992 | Bainbridge | 60/322 |
| 5,579,639 | 12/1996 | Shimoji | 60/322 |
| 5,606,857 | 3/1997 | Harada | 60/322 |

FOREIGN PATENT DOCUMENTS

| | | | |
|---|---|---|---|
| 60-162793 | 10/1985 | Japan . | |
| 4-116624 | 3/1991 | Japan . | |
| 5044460 | 2/1993 | Japan | 60/322 |

*Primary Examiner*—Thomas E. Denion
*Attorney, Agent, or Firm*—Finnegan, Henderson, Farabow, Garrett & Dunner, L.L.P.

[57] ABSTRACT

An exhaust device for an internal combustion engine with an exhaust pipe having a two pipe structure arranged such that the outer pipe and the inner pipe touch each other, the inner pipe being divided into first and second inner pipe sections at a location along the length of the inner pipe. The first and second inner pipes are arranged so that their facing ends are separated, in order to absorb shifts caused by thermal expansion of the pipe. The ends of both the outer pipe and the inner pipe are affixed together. The outer pipe may also be divided into first and second outer pipe sections at a location along the length of the outer pipe. The first and second outer pipe sections are joined in a telescopic joint.

14 Claims, 3 Drawing Sheets

EXHAUST DEVICE FOR AN INTERNAL COMBUSTION ENGINE

BACKGROUND OF THE INVENTION

1. Field of the Invention

The present invention relates to an exhaust device; and more particularly, to an exhaust device for an internal combustion engine.

2. Description of Related Art

Internal combustion engines use exhaust devices to discharge products of combustion into the atmosphere. In general, an exhaust device includes an exhaust manifold, a first length of exhaust pipe connected to the manifold, a catalytic converter or catalyst placed along the exhaust path downstream of the first length of pipe, and a second length of pipe connecting the catalyst to a muffler or other sound attenuating device from which the exhaust gases enter the atmosphere.

Japanese Published Utility Model 60-162793 discloses an exhaust device that includes thermally insulated double pipes consisting of an inner pipe and an outer pipe. An annular gap is formed between the inner periphery of the outer pipe and the outer periphery of the inner pipe. Thermally insulating material, the concentration of which varies according to the need for insulating capacity, fills the gap.

Japanese Published Utility Model 4-116624 also discloses an automobile exhaust device, which has a compound double pipe structure where the inner and outer pipes are formed as one single unit. The inner and outer pipes are spot welded to one another around the entire circumference near their ends, to increase the strength of the assembly.

FIG. 1 shows a conventional exhaust devices for internal combustion engines having a double pipe structure 112 for attachment, for example, either at an upstream end to a catalytic converter (not shown) and at the downstream end to a muffler (not shown). The double pipe structure 112 has an inner pipe 116 nested in, and in contact with an outer pipe 114. This type of attached double pipe structure has certain benefits compared to double pipe structures that have a gap between the inner and outer pipes. For example, it is simpler to manufacture, it does not require spacers for supporting the inner pipe in the outer pipe, a rise in back pressure is avoided, and the proper clearance with adjacent components is assured.

However, in conventional exhaust devices, the outer and the inner pipes, such as 114 and 116, are joined together at their upstream end (indicated by numeral 100) by bonding, for example by spot welding. These exhaust devices are heated by exhaust gases, and undergo thermal expansion. The nested inner and outer pipes are subject to different temperatures and thermal expansion rates, resulting in a different change in dimension of one pipe relative to the other. This relative change in dimension causes the contraction noise, which resembles a smacking sound. The contraction noise manifests itself particularly in pipes having a bend. The inner and outer pipes come into greater frictional contact in the bend area, generating a substantial frictional force at the interface between the pipes. The noise intensifies as the distance between the location where outer and inner pipes are bonded together, and the location of the bend in the exhaust pipe increases.

More specifically, the contraction noise in a pipe of conventional construction is generated by shifts in relative position between the inner pipe (116) and outer pipe (114). These contraction noises tend to increase in intensity as the distance A between the welded areas and the bend in the pipe increases. When a shift is about to occur, an intense frictional force develops opposing relative motion where the two pipes touch. Eventually, the thermal expansion energy becomes overwhelming, and the contraction noise occurs the instant one pipe shifts with respect to the other. In pipes with a bend, as shown in FIG. 1, the bend causes the greatest friction between the pipes, and is a primary source of contraction noise.

In view of the foregoing problems, there is a need for an exhaust pipe which avoids the problems associated with contraction noise.

SUMMARY OF THE INVENTION

Accordingly, the present invention is directed to an exhaust device for an internal combustion engine, which substantially obviates one or more of the problems due to the disadvantages and limitations of the prior art. These advantages include reducing the frictional force between the inner and outer pipes caused by thermal expansion, reducing the distance between the point of bonding and a bend in the pipe, countering the contraction noise, and achieving an economically advantageous structure.

Additional features and advantages of the invention will be set forth in the description which follows, and in part will be apparent from the description, or may be learned by practice of the invention. The objectives and other advantages of the invention will be realized and attained by the apparatus particularly pointed out in the written description and claims hereof as well as the appended drawings.

To achieve these and other advantages and in accordance with the purpose of the invention, as embodied and broadly described herein, the invention is an exhaust device for an internal combustion engine, which includes an outer exhaust pipe having a length defined by an upstream end and a downstream end; a first inner exhaust pipe section having a length defined by an upstream and a downstream end telescopically nested within said outer exhaust pipe and having an outer surface touching the outer exhaust pipe, said downstream end being positioned at a first location intermediate the upstream and downstream ends of the outer exhaust pipe; and a second inner exhaust pipe section having a length defined by an upstream and a downstream end telescopically nested within said outer exhaust pipe and having an outer surface touching the inner surface of the outer exhaust pipe, said upstream end of the second inner exhaust pipe section being positioned at a second location spaced a predetermined distance downstream of the first location.

It is to be understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and together with the description serve to explain the principles of the invention.

DESCRIPTION OF THE PREFERRED EMBODIMENT

Figure 1:
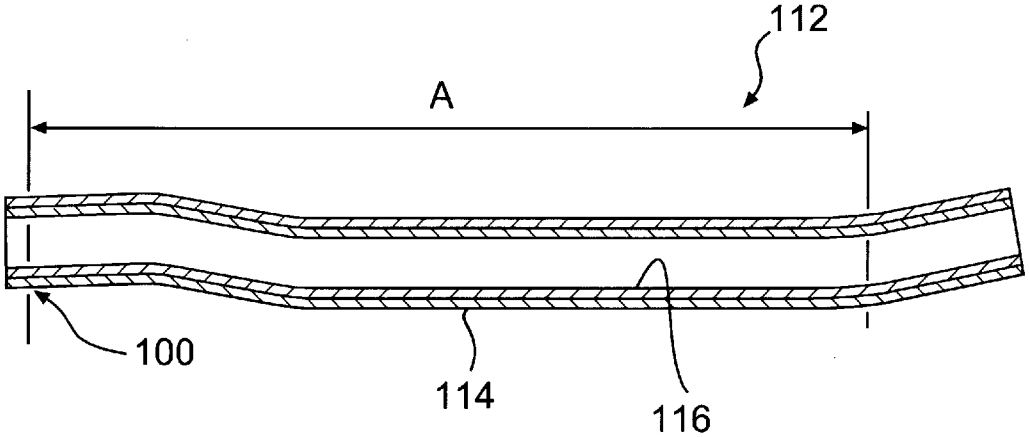
FIG. 1 is a fragmentary longitudinal sectional view of a conventional exhaust device.

Reference will now be made in detail to the present preferred embodiments of the invention, examples of which are illustrated in the accompanying drawings to the extent possible, like parts or elements have similar reference numerals. Throughout the specification and claims, the term "upstream" refers to the member or end into which the exhaust gas enters; and the term "downstream" refers to the end or member from which the exhaust gas exits.

Figure 2:
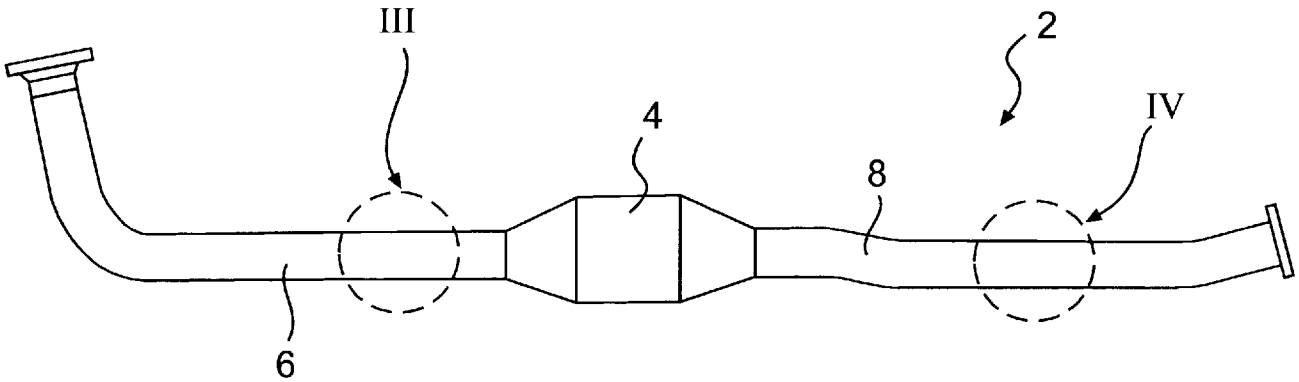
FIG. 2 is a side elevation view of an exhaust device for an internal combustion engine incorporating the present invention.
Figure 4:
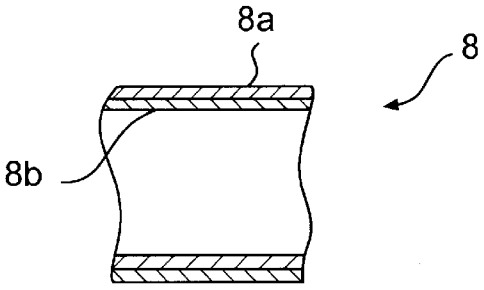
FIG. 4 is a fragmentary sectional view of the circled area referenced by the arrow IV in FIG. 2.
Figure 3:
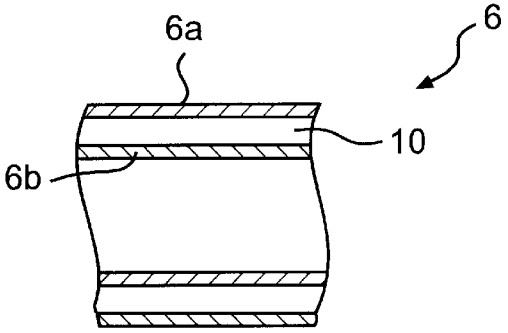
FIG. 3 is a fragmentary sectional view of the circled area referenced by the arrow III in FIG. 2.
Figure 5:
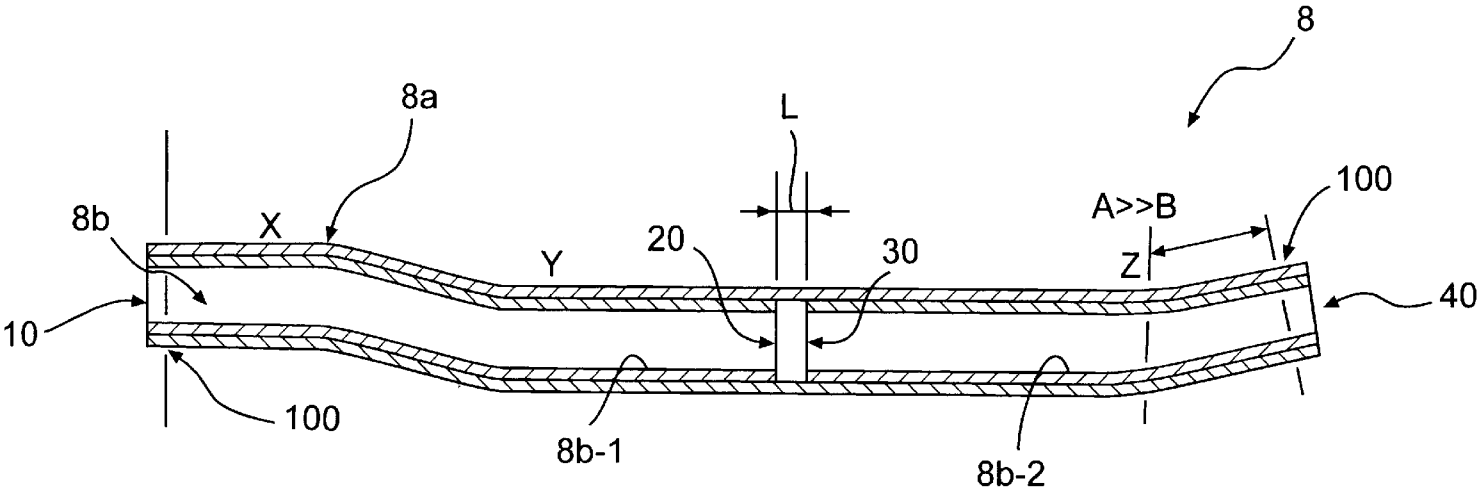
FIG. 5 is a fragmentary longitudinal sectional view of an exhaust device according to one embodiment of the present invention.

Referring to FIG. 2, en exhaust system 2 has an upstream pipe 6 and a downstream exhaust device 8. The upstream pipe 6 is connected at its upstream end to the exhaust manifold of an internal combustion engine (not shown). The downstream side of pipe 6 is connected to the inlet of a catalytic converter case 4. The downstream exhaust device 8 which is connected at its upstream end to the outlet of the catalytic converter case 4, may be connected at its downstream end to a muffler or other sound deadening device (not shown), for example. Referring to FIG. 3, the upstream pipe 6 is a dual pipe structure to prevent heat damage by insulating against exhaust heat. The pipe 6 has an outer pipe 6*a* and an inner pipe 6*b* inside the outer pipe. Pipes 6*a* and 6*b* are radially spaced from one another to form an annular gap 10, which provides a layer of air therebetween. Referring to FIG. 4 and in accordance with the invention, an exhaust device 8 includes a nested dual pipe structure. The device 8 has an outer pipe 8*a* and an inner pipe 8*b* inside the outer pipe. The outer surface of pipe 8*b* touches the inner surface of pipe 8*a*, leaving no annular gap between the two pipes. As shown in FIG. 5, the exhaust device 8 has longitudinally spaced bends X, Y, and Z.

In accordance with the invention, a first inner exhaust pipe section having a length defined by an upstream and a downstream end is telescopically nested within said outer exhaust pipe, and has an outer surface touching, or in other words in physical contact with the outer exhaust pipe, said downstream end being positioned at a first location intermediate the upstream and downstream ends of the outer exhaust pipe. As embodied herein, and referring to FIG. 5, a first inner exhaust pipe section 8*b*-1, which has a length defined by an upstream end 10 and a downstream end 20, is nested within the outer exhaust pipe 8*a*. The inner pipe section 8*b*-1 has an outer surface in contact with the inside of the outer pipe 8*a* along its length. The downstream end 20 of the inner pipe section 8*b*-1 is disposed at a first location, approximately midway between the upstream and downstream ends of the outer pipe 8*a*.

The device of the present invention further includes a second inner exhaust pipe section having a length defined by an upstream and a downstream end which is telescopically nested within said outer exhaust pipe and having an outer surface touching, or in other words in physical contact with the outer exhaust pipe, said upstream end being positioned at a second location intermediate the upstream and downstream ends of the outer exhaust pipe, said second location being spaced a predetermined distance downstream of the first location. As embodied herein, and referring to FIG. 5, a second inner exhaust pipe section 8*b*-2, which has a length defined by an upstream end 30 and a downstream end 40, is nested within the outer exhaust pipe 8*a*. The inner pipe section 8*b*-2 has an outer surface in contact with the inside of the outer pipe 8*a* along its length. The upstream end 30 of the inner pipe section 8*b*-2 is disposed at a second location, spaced a predetermined distance from the downstream end 20 of the first inner pipe section 8*b*-1.

The predetermined distance L between the first and second locations of the opposing ends of the inner pipe segments is sufficient to compensate for thermal expansion of the first and second inner pipe sections.

The first inner exhaust pipe section of the present invention is bonded to the outer exhaust pipe at the upstream end, and the second inner exhaust pipe section of the present invention is bonded to the outer exhaust pipe at the downstream end. As shown in FIG. 5, the locations marked by numeral 100 indicated where the upstream end of first inner pipe 8*b*-1 is bonded to outer pipe 8*a*, and where the downstream end of second inner pipe 8*b*-2 is bonded to outer pipe 8*a*.

Figure 6:
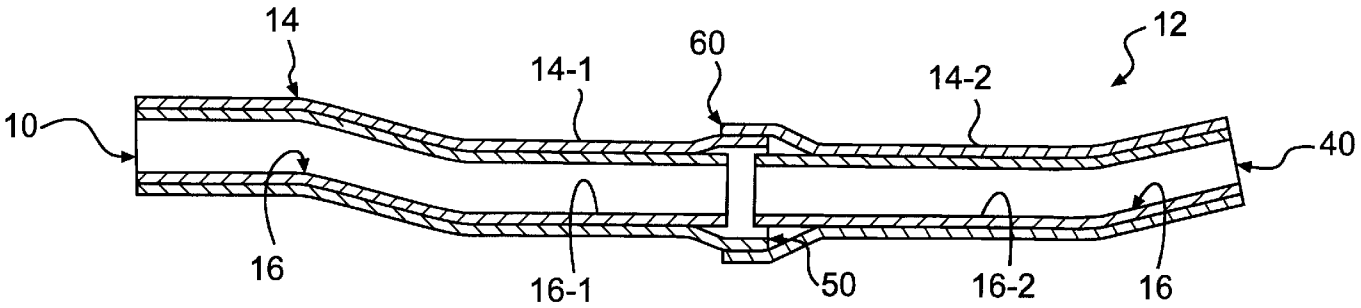
FIG. 6 is a fragmentary longitudinal sectional view of an exhaust device according to a second embodiment of the present invention.
Figure 7:
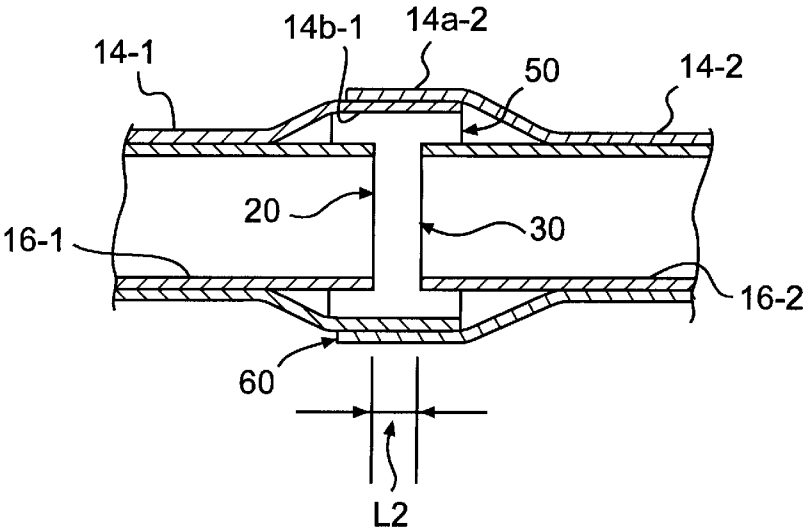
FIG. 7 is an enlarged fragmentary sectional view of the connecting portion of the device of FIG. 6.

In accordance with a second embodiment of the invention, the exhaust device may include an outer pipe divided into a first and a second outer pipe section, the first outer pipe section having a length defined by an upstream and a downstream end, said downstream end extending past the upstream end of the second inner pipe section, and the second outer pipe section having a length defined by an upstream and a downstream end, said upstream end extending past the downstream end of the first inner pipe section, and having the downstream end of the first outer pipe section joined to the upstream end of the second outer pipe section. As embodied herein, and referring to FIGS. 6 and 7, the outer pipe 14 is divided into a first outer pipe section 14-1 and a second outer pipe section 14-2. A first inner pipe section 16-1 is telescopically nested inside first outer pipe section 14-1. A second inner pipe section 16-2 is telescopically nested inside second outer pipe section 14-2. The first outer pipe section 14-1 is defined by an upstream end 10, and by a downstream end 50 which extends downstream past the location of the upstream end 30 of second inner pipe 16-2. Likewise, the second outer pipe section 14-2 is defined by a downstream end 40, and by an upstream end 60 which extends upstream past the location of the downstream end 20 of first inner pipe 16-1.

In accordance with the second embodiment of the invention, the downstream end of the first outer pipe section and the upstream end of the second outer pipe section may be joined in an overlapping or telescopic joint. As embodied herein, and referring to FIGS. 6 and 7, the downstream end of first outer pipe section 14-1 flares radially outward, and terminates in a cylindrical section 14-*b*1 of larger diameter than the section 14-1. The upstream end of second outer pipe 14-2 flares radially outward, and terminates in a cylindrical section 14-*a*2 of larger diameter than that of section 14-2. Cylindrical section 14-*a*2 is also of larger diameter than cylindrical section 14-*b*1, so that the two outer pipe section can be connected in an overlapping joint. The length of sections 14-*b*1 and 14-*a*2 can be chosen so that when assembled, a specific distance L2 will remain between the downstream end 20 of first inner pipe section 16-1, and the upstream end 30 of second inner pipe section 16-2.

Additionally, the periphery of the joint between the two outer pipe sections can be bonded, for example by spot welding.

It will be apparent to those skilled in the art that various modifications and variations can be made in the structure of the present invention without departing from the spirit or scope of the invention. Thus, it is intended that the present invention cover the modifications and variations of this invention provided they come within the scope of the appended claims and their equivalents.

What is claimed is:

1. An exhaust device for an internal combustion engine, comprising:

an outer exhaust pipe having a length defined by an upstream end and a downstream end;

a first inner exhaust pipe section having a length defined by an upstream and a downstream end telescopically nested within said outer exhaust pipe and having an outer surface touching the outer exhaust pipe, said downstream end of the first inner pipe section being positioned at a first location between the upstream and downstream ends of the outer exhaust piped; and a second inner exhaust pipe section having a length defined by an upstream and a downstream end telescopically nested within said outer exhaust pipe and having an outer surface touching the outer exhaust pipe, said upstream end of the second inner pipe section being positioned at a second location between the upstream and downstream ends of the outer exhaust pipe, said second location being spaced a predetermined distance downstream of the first location.

2. The exhaust device according to claim 1, wherein said predetermined distance is sufficient to compensate for thermal expansion of the first and second inner pipe sections.

3. The exhaust device according to claim 1, wherein said first inner exhaust pipe section is bonded to the outer exhaust pipe at the upstream end of the first inner exhaust pipe section, and wherein said second inner exhaust pipe section is bonded to the outer exhaust pipe at the downstream end of the second inner exhaust pipe section.

4. The exhaust device according to claim 1, wherein said outer exhaust pipe comprising a first outer pipe section and a second outer pipe section, said first outer pipe section having a length defined by an upstream and a downstream end of said section, said downstream end extending downstream beyond the upstream end of said second inner pipe section;

said second outer pipe section having a length defined by an upstream and a downstream end of said section, said upstream end extending upstream beyond the downstream end of said first inner pipe section;

said downstream end of said first outer pipe section and said upstream end of said second outer pipe section being joined at a location axially aligned with the space between the first and second inner pipe sections.

5. The exhaust device according to claim 4, wherein said downstream end of said first outer pipe section and said upstream end of said second outer pipe section are joined by an overlapping joint.

6. The exhaust device of claim 1 wherein the outer exhaust pipe and first inner exhaust pipe section are bent between the upstream end of the outer exhaust pipe and downstream end of the first inner exhaust pipe section.

7. The exhaust device of claim 4 wherein the first outer exhaust pipe and first inner exhaust pipe section are bent between the upstream end of the first outer exhaust pipe section and downstream end of the first inner exhaust pipe section.

8. The exhaust device of claim 1 wherein the outer exhaust pipe and second inner exhaust pipe section are bent between the upstream end of the second inner exhaust pipe section and the downstream end of the outer exhaust pipe.

9. The exhaust device of claim 4 wherein the second outer exhaust pipe and second inner exhaust pipe section are bent between the upstream end of the second inner exhaust pipe section and the downstream end of the second outer exhaust pipe section.

10. An exhaust system for an internal combustion engine, comprising:

a pipe connected at the upstream end to an exhaust manifold of an internal combustion engine;

a container for containing a catalyst, having an upstream end connected to a downstream end of said pipe;

an outer exhaust pipe having a length defined by an upstream end and a downstream end, said upstream end being connected to a downstream end of the container;

a first inner exhaust pipe section having a length defined by an upstream end and a downstream end telescopically nested within said outer exhaust pipe and having an outer surface touching an inner surface of the outer exhaust pipe, said downstream end of the first inner exhaust pipe section being positioned at a first location intermediate the upstream and downstream ends of the outer exhaust pipe; and a second inner exhaust pipe section having a length defined by an upstream end and a downstream end telescopically nested within said outer exhaust pipe and having an outer surface touching an inner surface of the outer exhaust pipe, said upstream end of the second inner exhaust pipe section being positioned at a second location spaced a predetermined distance downstream of the first location.

11. The exhaust device of claim 10 wherein the outer exhaust pipe is bonded to the first inner exhaust pipe section adjacent the upstream end of the first inner exhaust pipe section, and bonded to the second inner exhaust pipe section adjacent the downstream end of the second inner exhaust pipe section.

12. The exhaust device of claim 4 wherein the first outer exhaust pipe section is bonded to the first inner exhaust pipe section adjacent the upstream end of the first inner exhaust pipe section, and the second outer exhaust pipe section is bonded to the second inner exhaust pipe section adjacent the downstream end of the second inner exhaust pipe section.

13. The exhaust system of claim 10 wherein the outer exhaust pipe and first inner exhaust pipe section are bent between the upstream end of the outer exhaust pipe and downstream end of the first inner exhaust pipe section.

14. The exhaust system of claim 10 wherein the outer exhaust pipe and second inner exhaust pipe section are bent between the upstream end of the second inner exhaust pipe section and the downstream end of the outer exhaust pipe.

* * * * *

UNITED STATES PATENT AND TRADEMARK OFFICE

CERTIFICATE OF CORRECTION

PATENT NO. : 5,839,277
DATED : November 24, 1998
INVENTOR(S) : IDETA et al.

It is certified that error appears in the above-identified patent and that said Letters Patent is hereby corrected as shown below:

IN THE CLAIMS:

Claim 1, col. 5, line 23, "piped" should read --pipe--.

Signed and Sealed this

Sixteenth Day of March, 1999

*Attest:*

Q. TODD DICKINSON

*Attesting Officer*

*Acting Commissioner of Patents and Trademarks*